US005378223A

United States Patent [19]

Grim et al.

[11] Patent Number: 5,378,223

[45] Date of Patent: Jan. 3, 1995

[54] ORTHOPEDIC SUPPORT PAD AND METHOD FOR PROVIDING SEMI-PERMANENT RELIEF ZONES

[75] Inventors: Tracy E. Grim, Broken Arrow, Okla.; Joseph M. Iglesias, Agoura, Calif.

[73] Assignee: Royce Medical Company, Camarillo, Calif.

[21] Appl. No.: 965,750

[22] Filed: Oct. 23, 1992

[51] Int. Cl.[6] ..... A43B 5/04; A43B 7/06; A43B 13/40

[52] U.S. Cl. ..... 602/6; 602/61; 128/DIG. 20; 36/91

[58] Field of Search ..... 128/362, 376, DIG. 20; 602/6, 13, 23, 27, 53, 60, 61, 66; 5/453, 454; 607/1; 36/91, 93

[56] References Cited

U.S. PATENT DOCUMENTS

| | | | |
|---|---|---|---|
| 2,598,217 | 5/1952 | Bronson . | |
| 3,212,497 | 10/1965 | Dickinson | 602/6 |
| 3,631,854 | 1/1972 | Fryer | 128/DIG. 20 |
| 3,760,056 | 9/1973 | Rudy . | |
| 4,480,638 | 11/1984 | Schmid | 602/53 |
| 4,700,403 | 10/1987 | Vacanti | 2/22 |
| 4,817,590 | 4/1989 | Stancik, Jr. | 602/13 |
| 4,848,364 | 7/1989 | Bosman | 602/6 |
| 4,905,320 | 3/1990 | Squyers, Jr. | 2/22 |
| 5,078,128 | 1/1992 | Grim et al. . | |
| 5,088,478 | 2/1992 | Grim | 128/399 |
| 5,144,708 | 9/1992 | Pekar | 5/454 |
| 5,154,185 | 10/1992 | Latimer et al. | 602/6 |
| 5,158,767 | 10/1992 | Cohen et al. | 36/93 |

*Primary Examiner*—Paul Prebilic

*Attorney, Agent, or Firm*—Poms, Smith, Lande & Rose

[57] ABSTRACT

In an orthopedic support pad with semi-permanent relief zones, an airtight bladder is filled with a material which retains its shape when air is evacuated from the bladder during the formation process. The afflicted areas of an appendage are temporarily covered with padding and the support pad is then conformed to the wearer's particular anatomy. When the padding is subsequently removed, areas of pressure relief for the afflicted areas are maintained in the support pad.

6 Claims, 1 Drawing Sheet

Fig. 1.
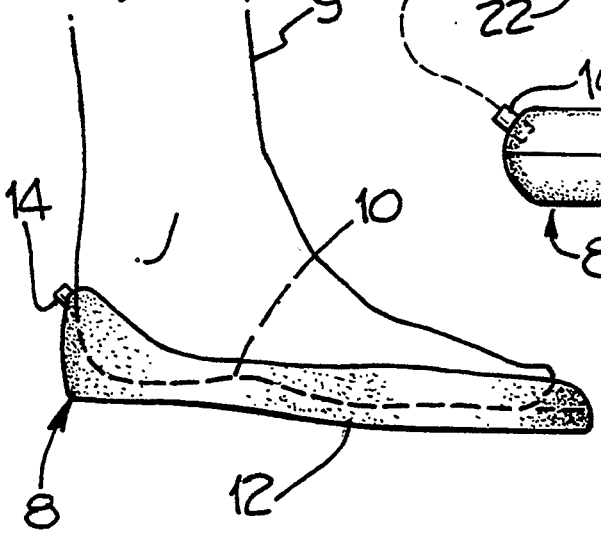
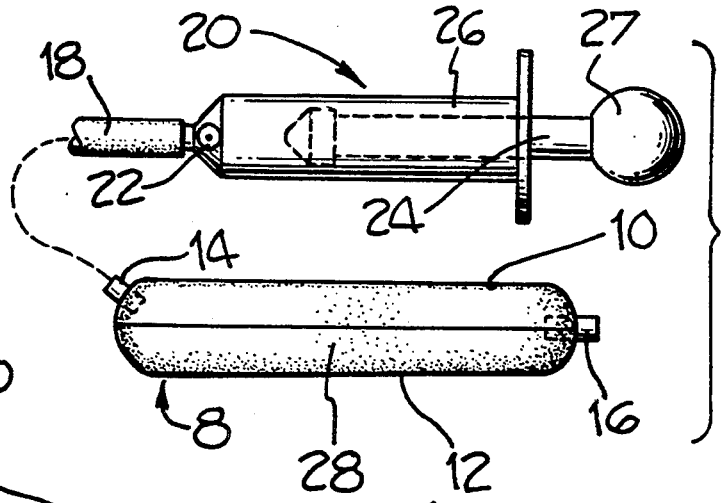
Fig. 2.
Fig. 3.
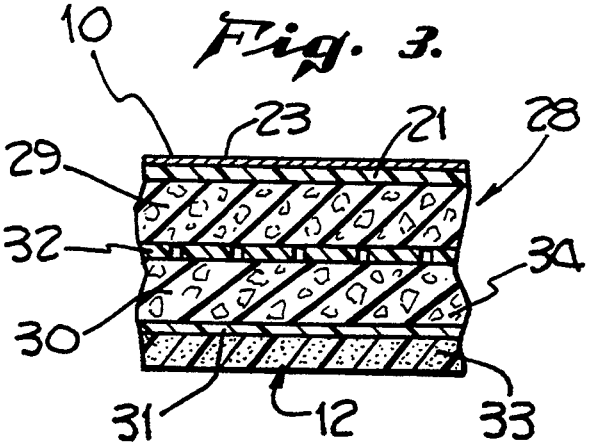
Fig. 5.
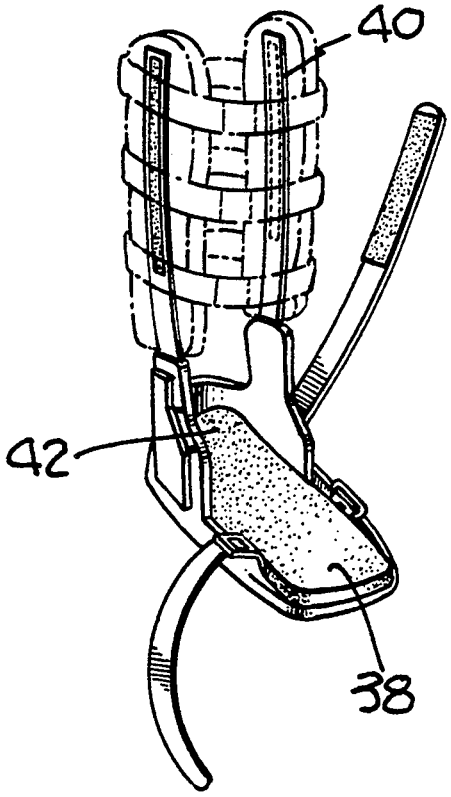
Fig. 4.
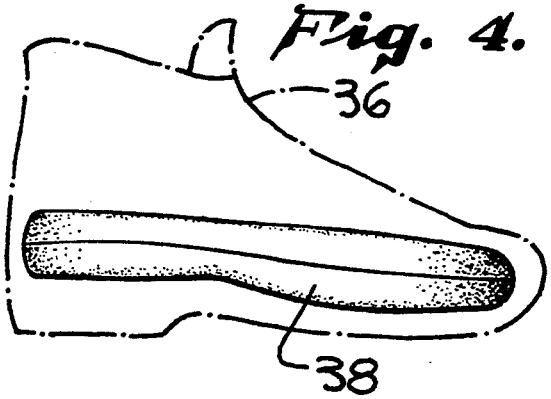

ORTHOPEDIC SUPPORT PAD AND METHOD FOR PROVIDING SEMI-PERMANENT RELIEF ZONES

FIELD OF THE INVENTION

The present invention relates generally to orthopedic devices, and more particularly to a conformable support pad to provide semi-permanent areas of pressure relief to the surface of an appendage.

BACKGROUND OF THE INVENTION

Support pads are used in a wide variety of applications to provide cushioned support to an injured or otherwise sensitive bodily appendage. Such pads have the dual purpose of (1) providing orthopedic support to the appendage and (2) protecting the appendage from further injury or damage resulting from contact with a foreign object or hard surface.

One common use of a support pad is as a cushioned foot sole in specialized footwear such as soft boots or patient walkers. These devices generally employ some type of soft, resilient material, such as foam, to provide cushioned support of a sensitive or damaged foot.

A particular problem arises when it becomes necessary to provide uneven support across the outer surface of an appendage. For example, an ulcerated appendage, often found in diabetic patients, requires pressure relief to the ulcerated area to allow healing. In this instance, it is desirable to have a pad which will apply cushioned support to the appendage, while refraining from supporting the afflicted area. For diabetic patients, the feet are commonly beset with such ulcerations, and it is therefore desirable to provide a cushioned support sole for a shoe or walker which is capable of providing specific zones of pressure relief.

Other approaches have addressed the problem of providing cushioned foot support. U.S. Pat. No. 2,598,217 (Bronson), issued May 27, 1952, discloses an invalid's boot with a thick insole. However, these approaches require replacement of the sole for each new patient, or for each new area of the original patient's foot which must be relieved.

U.S. Pat. No. 3,760,056 (Rudy), teaches a method for conforming a ski boot to the foot of the wearer by heating an inflatable bladder, distending it to the desired shape, and then cooling and deflating the bladder. The bladder can subsequently be re-inflated to fit the wearer's foot. This method requires a mechanism for heating, which may be inconvenient or impractical when applied to a conformable sole. In the method disclosed, the inflatable bladder was placed over the foot to contact opposing sides, rather than underneath it as a support. Moreover, the elastomeric materials described in Rudy typically may not provide the requisite comfort and cushioning generally required in a healing device.

A further method of providing support to an injured foot is disclosed in U.S. Pat. No. 5,078,128 (Grim, et al.) in which a removable leg walker includes a plurality of inflatable and adjustable bladder members in order to provide variable amounts of pressure to an affected limb as leg swelling increases or decreases. However, the bladder members of the Grim device do not retain their shape except as restrained by the surface of the appendage itself and thus do not provide the desired semi-permanent areas of relief to an injured appendage.

Accordingly, a principal object of the present invention is to provide a comfortable cushioned sole which may be conveniently conformed to fit a wearer's foot, and which will provide pressure relief to specific areas of the wearer's foot.

Another important object of the invention is to furnish a device which may be reused to provide relief to different areas of the patient's foot, or which may be used by other patients.

A further object is to provide a method for conforming a cushioned sole to the foot of a particular wearer, and of later reforming or returning the sole to its original shape.

SUMMARY OF THE INVENTION

In an orthopedic support pad with semi-permanent relief zones, a resilient pad or bladder contains a filler substance which holds a conformed configuration at reduced pressure or upon evacuation, means for removing air or other fluid including liquids from the pad in a controlled manner to conform the sole to a wearer's anatomy, and means for reintroducing new amounts of air into the pad to reform or return the pad to its original shape.

In one exemplary embodiment of the present invention, a foot pad containing a bladder filled with air uses the principle of a self-inflating bladder in reverse. The pad is in an "inflated" or atmospheric pressure state prior to forming. The patient applies pressure to the pad, preferably by stepping on it with the injured This pressure forces air out of the bladder, allowing it to form to the shape of the bottom of the patient's foot. Air or other fluid is then withdrawn from the bladder by a hand operated vacuum pump, or other techniques. The shape is then maintained in the pad by the structure of a filler substance, which may be particulate material held together by the partial vacuum. When recharging and reforming is desired, air is allowed to re-enter the bladder and the pad returns to its original shape.

In accordance with one aspect of the invention, the pad can be adapted for use with an ulcerated appendage, such as is commonly found in a diabetic patient, which requires pressure relief to heal. In this example, a thick gauze padding may be secured to the sole of the foot over the ulcerated area during the forming process, causing the upper surface of the orthopedic sole to make contact with the entire surface of the foot or thin sock, except in the area of the gauze padding where the sole is depressed. After forming, the gauze is removed, or a lighter gauze bandage applied, thereby providing relief for the ulcerated area from the supporting pressure against the sole, and resulting in more rapid healing of the ulcer.

In accordance with further aspects of the invention, the pad of the orthopedic sole is easily reformable as necessary throughout the healing process. The area of pressure relief can be resized or relocated. Thus, there is no need for a new pad to be purchased for each such change.

The present invention may be used in walkers or orthopaedic ankle supports, but is not limited to support pads used to cushion feet, and may be applied to any appendage in need of specific areas of pressure relief, such as an arm or leg encased in a splint or cast arrangement.

Other objects, features, and advantages of the invention will become apparent from a consideration of the following detailed description and from the accompanying drawings.

BRIEF DESCRIPTION OF THE DRAWINGS

FIG. 1 is a side view showing an orthopedic support pad conformed to the foot of a wearer;

FIG. 2 shows the exterior of the orthopedic support pad including inlet and outlet valves;

FIG. 3 is a cutaway perspective view showing the inner construction of the support pad;

FIG. 4 is a perspective cutaway view showing one particular embodiment of the invention as a diabetic foot pad inserted into a soft boot; and FIG. 5 shows the diabetic foot pad as a soft good installed in a patient walker.

DETAILED DESCRIPTION OF THE PREFERRED EMBODIMENTS

Referring more particularly to the drawings, FIG. 1 shows one exemplary embodiment of the invention as a conformable support pad 8 to provide semi-permanent areas of pressure relief to the foot 9 of a wearer. The wearer's foot 9 is in immediate contact with, and is supported by an upper surface 10 of the support pad 8. A valve 14 is provided as a means for exhausting air from, or for permitting the flow of air into the support pad 8 during the reforming process as described more fully below.

Referring next to FIG. 2, an exemplary support pad 8 is shown in its unconformed state prior to a specific use. The upper surface 10 and the lower surface 12 form an airtight bladder 28 constructed of resilient material which is compliant to an appendage placed in contact with the upper surface 10. An exhaust valve 14 and an inlet valve 16 provide means, respectively, for evacuating air from, and permitting the flow of air into the airtight inner bladder 28. These two valves may be combined into a single valve structure with means for opening the valve to permit inflow of air. The inlet valve 16 can be of any type which blocks the flow of air inward to the inner bladder 28, but which may be opened, including without limitation a mechanically operated valve which can be opened by the pressing of a button or other mechanical means.

FIG. 2 also shows a hand pump 20 which may be used to draw air out of the inner bladder 28. The valve 22 is closed during evacuation when the plunger is pulled to the right, but is open to release air when the plunger is moved to the left. An additional one-way valve 14 is included between the bladder 12 and the pump. A syringe-type plunger 24 may be reciprocated in the cylindrical chamber 26. Of course, the one-way valve 14 may be integral with the pump or in the line 18 instead of at the exhaust port from bladder 28. As the handle 27 is pulled to the right, as shown in FIG. 2., air is drawn out of the bladder 28.

The method of forming semi-permanent areas of pressure relief in a foot support can be understood by referring to FIG. 1 and FIG. 2. The support pad 8 is in an "inflated" or atmospheric pressure state prior to forming. The wearer applies pressure to the pad, preferably by stepping on it, with the injured foot 9. This pressure forces air out of the inner bladder 28 through release valve 14, allowing the support pad 8, and in particular the upper layer 10, to conform to the shape of the bottom of the foot 9. The large syringe-type pump 20 may then be used to further remove air from the support pad 8 by connecting the line 18 to exhaust valve 14 and drawing air out of the inner bladder 28 by creating a partial vacuum through suction, when the plunger 24 is actuated to the right, as shown in FIG. 2. When the air is drawn out of the bladder 28, the particulate material therein is pulled or pressed together and retains the configuration of the foot. The support may then be sealed to prevent further modification of the fluidic contents of the support pad. The shape is subsequently maintained in the support pad 8 because air is not allowed back into the inner bladder 28. When it is desired to "recharge" or reform the support pad 8, air is reintroduced to inner bladder 28 via valve 14 or 16, and the support pad 8 returns to its original shape as shown in FIG. 2.

The support pad 8 can be adapted for an ulcerated appendage, such as that commonly found in a diabetic patient, which requires pressure relief to heal. By padding the ulcerated area with temporary padding such as gauze or similar material during forming, the support pad 8 makes complete contact with the sole of the foot 9, except where the gauze padding is placed. After formation, the temporary padding is removed, or replaced with thinner padding placed on the bottom of the foot 9. The conformed support is then secured to the appendage, thereby relieving the contact in the afflicted area and allowing the ulcer to heal more rapidly. The support pad 8 may be reformed as often as required, for use with different wearers or for modifying the areas of relief for the present wearer.

In FIG. 3, a cutaway view exposes the inner construction of the support pad 8. The upper surface 10 is preferably composed of a thin layer 21 of urethane or similar material covered with a thin layer 23 of tricot, brushed nylon or LYCRA or nylon material. LYCRA is a trademark for a polyurethane spandex fiber. It is desirable that such material be washable to allow cleaning of the support pad 8. The upper surface 10 is the upper enclosing surface of an airtight inner bladder 28 which is filled with a filler substance 29. The filler substance 29 provides the support pad 8 with its shape and is preferably comprised of semi-flexible, substantially spherical particles. Good results have been obtained using polyethylene particles of a generally spherical configuration. Any construction capable of maintaining the shape of the pad when air is drawn out may be used, including without limitation particles of other materials, open cell, slow foam, reticulated or closed cell type foam beads which may be substantially spherical. The lower surface 12 includes a bottom-out safety layer 30 which cushions the support pad 8 against contacts from underneath. The safety layer 30 is preferably constructed of a urethane sublayer 32 laminated to a foam sublayer 34. In FIG. 3, the urethane sublayer 32 is shown above the foam sublayer 34, although these two layers could clearly be reversed. Alternatively, the safety layer 30 could be comprised of two urethane sublayers, laminated to the upper and lower surfaces of a foam sublayer.

With further reference to FIG. 3, as an alternative implementation of the orthopaedic support pad 8, it may include the upper and lower urethane layers 21 and 31 which are sealed to form the bladder 28. In addition, it may include the upper thin layer 23 of tricot, brushed nylon or LYCRA or nylon material. The central layer 32 may be an apertured separating layer of thin sheet plastic such as urethane. In the zone 34 on one side of sheet 32, coarser particles or spheres of plastic 44 such as 1/16 or ⅛ inch polyethylene particles may be located. Finer particulate material 46, such as generally spherical particles of about 1/32 inch diameter or less, may be located on the other side of sheet 32 for greater comfort in cushioning the sole of the foot. The lowest layer 33 may be made of foam rubber or other heavy duty resilient material as a safety layer.

FIG. 4 illustrates one particular embodiment of the support pad as a diabetic foot pad 38 inserted into a soft boot or shoe 36 with rigid sole. The diabetic foot pad 38 is constructed in the manner explained hereinabove, and can be conformed to an ulcerated foot by the method explained herein.

In FIG. 5, the diabetic foot pad 38 is shown as an insert in a patient walker 40. Such walkers are common in the art and an exemplary construction may be found in U.S. Pat. No. 5,078,128 (Grim, et al.). As shown in FIG. 5, the rear or cantilever section of the walker 40 can be equipped with a pump 42 under the heel and operated by the patient's walking action to evacuate air from the foot pad 38 as described above. This could take the place of or supplement the hand operated pump.

In conclusion, it is to be understood that the foregoing detailed description and the accompanying drawings relate to an illustrative embodiment of the invention. Various changes and modifications may be made without departing from the spirit and scope of the invention. Thus, by way of example and not of limitation, the filler substance 29 of the support pad 8 may be constructed of foam or other flexible semi-resilient material rather than the preferred bead material. The foot pad 38 could be used in any arrangement where it is necessary to provide areas of pressure relief, including for example, the situation in which a cut or abrasion to the sole of the wearer's foot requires pressure relief to promote comfort or healing.

The shape and exterior dimensions of the orthopedic support pad can be varied to meet specific applications without exceeding the principles of the present invention. Thus for example, in a foot pad the thickness may be approximately 3/8 inches, and it is preferably between $\frac{1}{4}$ inches and $\frac{1}{2}$ inches. The shape of the support pad can be adapted to fit in a variety of devices and orthopedic restraints.

The support pad as described herein is not limited to use as a support for a foot, and it is envisioned that such a pad may be used for any appendage requiring zones of pressure relief. Thus, again by way of example and not limitation, a support pad could be used in a splint or cast arrangement to immobilize an arm or leg while refraining from contact with specific afflicted surface areas of the arm or leg. Accordingly, the present invention is not precisely limited to the system as shown in the drawings and as described in detail hereinabove.

What is claimed is:

1. A conformable foot pad comprising:

an airtight compliant bladder having a configuration to underlie the sole of the foot of a user;

said airtight bladder containing means for retaining a predetermined configuration following partial evacuation;

one-way valve means coupled to said bladder to facilitate withdrawing air from said bladder so that the bladder will retain its shape, including the upper surface configuration thereof for facing the sole of the foot of the user; and means for selectively permitting the inflow of air into said bladder to facilitate reconfiguration thereof; wherein:

said bladder contains resilient particulate material; and said bladder includes an apertured separating layer of sheet plastic with fine particulate material on one side of said sheet and coarser particulate material on the other side thereof.

2. A method for conforming an orthopedic support pad to provide semi-permanent areas of pressure relief to afflicted areas of an appendage, the method comprising the steps of:

preparing a support pad including a fluid and an airtight bladder containing semi-flexible particles which are freely formable under atmospheric pressure conditions but which retain a conformed configuration when the bladder is evacuated;

applying a temporary padding of material to the afflicted areas of said appendage;

evacuating the fluidic contents of said support pad to alter the shape of the pad to a conformed shape, wherein said shape conforms to that of said appendage as modified by said temporary padding;

maintaining said conformed shape with semi-flexible particles inside said pad;

sealing said support pad to prevent further modification of the fluidic contents of the support pad;

removing said temporary padding from said appendage; and securing said conformed support pad to said appendage.

3. The method for conforming an orthopedic support pad to provide semi-permanent areas of pressure relief defined in claim 2 wherein said appendage is a human foot.

4. The method for conforming an orthopedic support pad to provide semi-permanent areas of pressure relief as defined in claim 3 wherein the step of evacuating the fluidic contents of the pad is initiated by the intended wearer applying pressure to said pad with said foot.

5. The method for conforming an orthopedic support pad to provide semi-permanent areas of pressure relief defined in claim 2 further comprising the step of using a pumping mechanism to evacuate said fluidic contents.

6. The method for conforming an orthopedic support pad to provide semi-permanent areas of pressure relief defined in claim 2 further including the step of introducing new amounts of said fluid into said support pad to eradicate said conformed shape and return said support pad substantially to its original shape.

* * * * *